US011167338B2

(12) United States Patent
Busch et al.

(10) Patent No.: US 11,167,338 B2
(45) Date of Patent: Nov. 9, 2021

(54) HYDRAULIC CYLINDER

(71) Applicant: SMS group GmbH, Düsseldorf (DE)

(72) Inventors: Karsten Busch, Mönchengladbach (DE); Paul-Josef Nieschwietz, Erkelenz (DE); Frederik Knauf, Nideggen-Abenden (DE)

(73) Assignee: SMS group GmbH, Dusseldorf (DE)

( * ) Notice: Subject to any disclaimer, the term of this patent is extended or adjusted under 35 U.S.C. 154(b) by 354 days.

(21) Appl. No.: 16/092,871

(22) PCT Filed: Mar. 31, 2017

(86) PCT No.: PCT/EP2017/057708
§ 371 (c)(1),
(2) Date: Oct. 11, 2018

(87) PCT Pub. No.: WO2017/178249
PCT Pub. Date: Oct. 19, 2017

(65) Prior Publication Data

US 2019/0217373 A1 Jul. 18, 2019

(30) Foreign Application Priority Data

Apr. 11, 2016 (DE) ..... 10 2016 205 973.4

(51) Int. Cl.
*F15B 11/02* (2006.01)
*B21J 9/12* (2006.01)
(Continued)

(52) U.S. Cl.
CPC ..... *B21J 9/12* (2013.01); *F15B 11/022* (2013.01); *F15B 11/036* (2013.01);
(Continued)

(58) Field of Classification Search
CPC ..... F15B 15/1428; F15B 15/1447; F15B 2211/428; F15B 2211/7055; F15B 11/022; F15B 2211/75
See application file for complete search history.

(56) References Cited

U.S. PATENT DOCUMENTS 3,186,305 A 6/1965 Lorimer
4,343,226 A * 8/1982 Ribeiro de Almeida ..... B21D 5/02 91/171

(Continued)

FOREIGN PATENT DOCUMENTS

DE 22 20 180 A1 11/1973
DE 198 46 348 A1 4/1999

(Continued)

OTHER PUBLICATIONS

International Search Report dated Oct. 30, 2017 of corresponding International application No. PCT/EP2017/057708; 8 pgs.

(Continued)

*Primary Examiner* — Thomas E Lazo
(74) *Attorney, Agent, or Firm* — Maier & Maier, PLLC

(57) ABSTRACT

A hydraulic cylinder comprising a cylinder, a piston element movably guided in the cylinder in a working direction and comprising an active surface, and a first opening for feeding a fluid into a cylinder chamber by the active surface. A working pressure of the fluid acting on the active surface drives the piston element in the working direction. The active surface includes a first partial surface and at least one second partial surface, the cylinder chamber being divided into a first sub chamber with the first opening by the first active surface and a second partial surface with a second opening by the second partial surface, and the partial surfaces are hydraulically separated from each other at least in a selectable operating mode.

11 Claims, 3 Drawing Sheets

(51) Int. Cl.
*F15B 11/036* (2006.01)
*F15B 15/14* (2006.01)

(52) U.S. Cl.
CPC ..... *F15B 15/1428* (2013.01); *F15B 15/1447* (2013.01); *F15B 2211/428* (2013.01); *F15B 2211/7055* (2013.01); *F15B 2211/75* (2013.01); *F15B 2211/775* (2013.01)

(56) References Cited

U.S. PATENT DOCUMENTS 6,145,307 A * 11/2000 Dantlgraber ..... B66F 9/22 60/327
6,240,758 B1 * 6/2001 Nagakura ..... B21D 5/02 72/16.9
6,401,516 B1 * 6/2002 Herndl ..... B21J 7/28 72/453.18
9,044,913 B2 * 6/2015 Kurz ..... B30B 15/163
2003/0084794 A1 * 5/2003 Koyama ..... F15B 11/022 100/269.01

FOREIGN PATENT DOCUMENTS

| | | | |
|---|---|---|---|
| DE | 60 2005 003 696 | T2 | 12/2008 |
| JP | H08-14212 | A | 1/1996 |
| JP | H08-334102 | A | 12/1996 |
| JP | 2003-136288 | A | 5/2003 |
| JP | 2003-172311 | A | 6/2003 |
| JP | 2012-002272 | A | 1/2012 |

OTHER PUBLICATIONS

Written Opinion of the International Search Authority dated Oct. 30, 2017 of corresponding International application No. PCT/EP2017/057708; 7 pgs.

* cited by examiner

HYDRAULIC CYLINDER

FIELD

A hydraulic cylinder according to the preamble of claim 1 as well as a forming machine with a hydraulic cylinder according to the invention.

BACKGROUND

DE 198 46 348 A1 describes a forging press in which hydraulic cylinders are provided as drive units for forming tools. Such hydraulic cylinders allow both a large force as well as a long travel path. The providing of these attributes requires a correspondingly high delivery capacity of a hydraulic pump.

SUMMARY

It is the object of the invention to indicate a hydraulic cylinder that combines large forces and long travel paths with low drive power.

By dividing the active surface or the hydraulically admissible volume into at least two partial chambers one can realize a different actuation in each case, depending on the requirements. For example, for the same fluid feed capacity, either a rapid advancement of the piston under low working force or a slow advancement under high working force can be selected. On the whole, this allows an optimization of the applications of the hydraulic cylinder in terms of minimizing the drive power.

By a hydraulic cylinder is generally meant, in the sense of the invention, an actuating element driven by a hydraulic fluid, preferably a liquid. The fluid is preferably a hydraulic oil, as is customarily used in hydraulic cylinders. The cylinder of the hydraulic cylinder is not necessarily of a circular cross section in the sense of the invention, so that the term "cylinder" refers in the present instance to the function and not necessarily to a geometrical shape. According to the predominant practice in the design of hydraulic cylinders, however, a circular cross section of the cylinder will be chosen with preference. In one possible alternative, the cylinder may also have an elliptical cross section. This would prevent a rotating of the piston element in the cylinder. Furthermore, any transverse forces occurring could be better absorbed.

An active surface, in the sense of the invention, is a surface of the piston element on which the working pressure of the fluid can work in order to press the piston element in the working direction. The physical active surface need not be flat or extend perpendicular to the working direction, whereby, however, only its projected portion perpendicular to the working direction contributes to the driving force of the piston element.

A cylinder chamber, in the sense of the invention, is the entire space that the fluid fills in the cylinder depending on the position of the piston element.

According to the division of the cylinder chamber into two hydraulically separable partial chambers according to the invention, the entire cylinder chamber need not be under the working pressure of the fluid. Depending on the operating mode in each case, one of the partial chambers may also be pressure-free or substantially under atmospheric pressure. If need be, both partial chambers may also be under different working pressures. In the sense of the invention, more than two hydraulically separated partial chambers may also be provided.

A ratio of the sizes of the two partial surfaces may be adjusted as required each time. A ratio in the range between 50:50 and 20:80 is expedient for many applications. For an asymmetrical ratio of the sizes of the partial surfaces of 30:70, for example, a multiple gradation of the force admission becomes possible, i.e., 30%, 70% and 100% of a maximum force, for example, depending on the admission of fluid to the partial chambers in each case.

In one preferred detail configuration, a ratio of the partial surfaces is asymmetrical and lies between 45:55 and 20:80, most preferably between 40:60 and 20:80. This enables a targeted admission of fluid to the partial chambers, for example, also during a forging process. Thus, at the start of a forging process an initial block is short and large in diameter. The heat loss is then slight, due to the ratio of surface to volume. That is, in such an instance, forging can be achieved with a low stroke frequency, but large pressing forces are required. In the course of the forging, when the initial block has been shaped to a final geometry, it cools down more rapidly. This requires a higher stroke frequency, whereby, however, the required pressing force is no longer as large, since the pressed surface becomes smaller.

In the interest of a simple structural embodiment, it may be provided that the partial chambers extend concentrically about a center axis of the cylinder. In an especially expedient detail configuration, on one of the two, the piston element or the cylinder, a step, especially a cylindrical step, protrudes for separating the partial chambers parallel to the working direction. In this way, for example, the one partial chamber may form a full cylindrical chamber, which is surrounded by the second partial chamber in the form of an annular cylinder, which furthermore is offset from the first partial chamber in the working direction.

It is generally advantageously provided that the partial chambers are connected to a hydraulic pump unit and a valve assembly, wherein the valve assembly allows the partial chambers to admit fluid in at least two operating modes. In particular, in this way most or all of the hydraulically switching components can be situated outside the hydraulic cylinder.

In one preferred embodiment, in a first of the operating modes, a rapid advancement of the piston element occurs under reduced piston force, while in a second of the operating modes a slow advancement of the piston element occurs under high piston force, and wherein the operating modes are realized under working pressure by different admission of fluid to the partial chambers.

In an especially preferred embodiment, it is provided that the valve assembly comprises a control valve with a pilot piston which is movable in the working direction. Such pilot pistons as control valves are known, for example, from the above-cited DE 198 46 348 A1 and they allow a fast and accurate actuation of the hydraulic cylinder. During its advancement, the pilot piston closes a drain of the cylinder, which in turn results in a pressure buildup and advancement of the piston element.

For the simple realization of a lower pump power, one of the partial chambers can be connected by the valve assembly to a hydraulic reservoir. In one possible embodiment, the hydraulic reservoir is pressure-free. This ensures a filling and emptying of the partial chamber that is not subject to working pressure in the course of the piston movement, so that a rapid admission of fluid under working pressure to the second partial chamber is possible at all times. A pressure-free hydraulic reservoir, in the sense of the invention, means that either atmospheric pressure or also a higher pressure is present in the reservoir to ensure a rapid exchange of fluid.

The hydraulic reservoir, in particular, can be designed as a pressure storage unit in the form of a hydraulic accumulator. The accumulator may be realized, for example, as a spring accumulator, or in another way. Basically, however, it is also possible for the hydraulic reservoir to be subjected to pressure when so required.

In another embodiment of the invention, at least one of the partial chambers, preferably both partial chambers, can be subjected to the fluid by means of a valve downstream from the partial chamber. When the valve is open, the fluid then flows pressure-free through the partial chamber or a branch, and when the valve is closed or throttled, a corresponding admission of pressure to the respective partial chamber occurs.

Generally advantageously, the hydraulic cylinder has a resetting active surface, wherein the piston element can be reset against the working direction by admitting the fluid to the resetting active surface. This enables a simple hydraulic resetting of the piston element. But the resetting can also be accomplished in another way, depending on requirements in each case.

The present invention has substantial benefits for large hydraulic cylinders, since considerable expense arises here in providing the hydraulic pumps and the electrical power supply. Accordingly, it is advantageously provided that the entire active surface of the piston element amounts to at least 1000 $cm^2$, especially at least 2000 $cm^2$. The working pressures of the fluid are chosen in the traditional manner and typically lie in the range between 200 and 500 bars. Preferred maximum forces of the piston element amount to more than 3 MN, preferably between 5 and 30 MN or more.

In one possible enhancement of the invention, it is provided that three or more hydraulically separable partial chambers are provided with their associated partial surfaces of the piston element. This allows an even further differentiation of the pressing forces and stroke speeds of the piston element. The partial chambers, in particular, may extend concentrically to each other. Analogously to the embodiments with only two partial chambers, the separation of the partial chambers can be made by means of corresponding steps on the piston element and/or cylinder.

An especially preferred use of a hydraulic cylinder according to the invention involves the field of large forming machines, especially forging presses. The invention therefore relates to a forming machine for the shaping of a workpiece, wherein a tool of the forming machine can be subjected to a forming force by means of a hydraulic cylinder according to the invention.

In a preferred embodiment, the forming force is exerted solely by one or more hydraulic cylinders, so that no additional mechanical force transmission is required, such as by a shaft. Such a design of the forming machine is especially favored due to the flexibility of a hydraulic cylinder according to the invention.

In one preferred embodiment, the forming machine is designed as a radial forging machine. Especially preferred, the radial forging machine comprises at least four tools working against each other in pairs. However, the invention is not restricted to a radial forging machine, but instead can also find application in hydraulic presses, such as, for example, free-form forging presses, joint presses or extruders, as well as in hydraulic hammers.

In general, advantageously, in a first operating mode, a smoothing of the workpiece is produced under admission of fluid only to one of the partial chambers, while in a second operating mode of the forming machine, a forging of the workpiece is produced under admission of fluid under working pressure to both partial chambers. This allows an effective use of the same forming machine for different shaping methods.

Furthermore, advantageously, in one operating mode, a rapid positioning of the piston element results under admission of fluid under working pressure to only one of the partial chambers, while after the positioning, there takes place a forming of the workpiece under admission of fluid under working pressure to both partial chambers. This enables a reduced power of a hydraulic supply unit for otherwise identical performance data regarding the speed and maximum force of the forming machine.

In general, advantageously, a hydraulic cylinder according to the invention can be designed to replace a traditional hydraulic cylinder of existing forming machines.

In simple terms, the invention as well as additional advantages may be described as follows. A variable ratio of the partial surfaces according to requirements enables the greatest possible flexibility in terms of the achievable number of strokes, which is especially advantageous in the shaping of temperature-critical materials. Thanks to the partitioning of the partial surfaces in combination with suitable forging strategies, a reduction of the installed power and thus an energy savings is possible, with comparable productivity at the same time. Furthermore, it is advantageous that a partitioning of the partial surfaces is also basically possible for existing installations.

The advantage of the energy saving is even greater when using an energy storage mechanism, such as one in the form of a flywheel which stores energy during the idle stroke and delivers it as needed.

The invention can be used regardless of the forging strategy. For example, it is possible to employ a conventional strategy, such as is used in free-form forging, and is characterized by large advancement without rotation of the workpiece, but making use of four tools acting on the workpiece at the same time. When this forging strategy is used, large numbers of strokes can be realized in a simple way. When the invention is used in combination with a strategy in which two oppositely situated tools of a radial forging machine are acting on the workpiece, again large stroke numbers can be realized in conjunction with an even further optimized core forging.

The productivity can be increased even more if the hydraulic cylinder of the invention is used with a shifting of tools, i.e., an adapting of the forging region by means of tools.

All these combination possibilities lead to a significant productivity enhancement by improving the core forging of workpieces, with less energy demand at the same time.

Further advantages and features will emerge from the following described exemplary embodiments as well as from the dependent claims.

BRIEF DESCRIPTION OF THE DRAWINGS

In the following, preferred embodiments of the invention shall be described and explained with the aid of the accompanying drawings.

DETAILED DESCRIPTION

Figure 1:
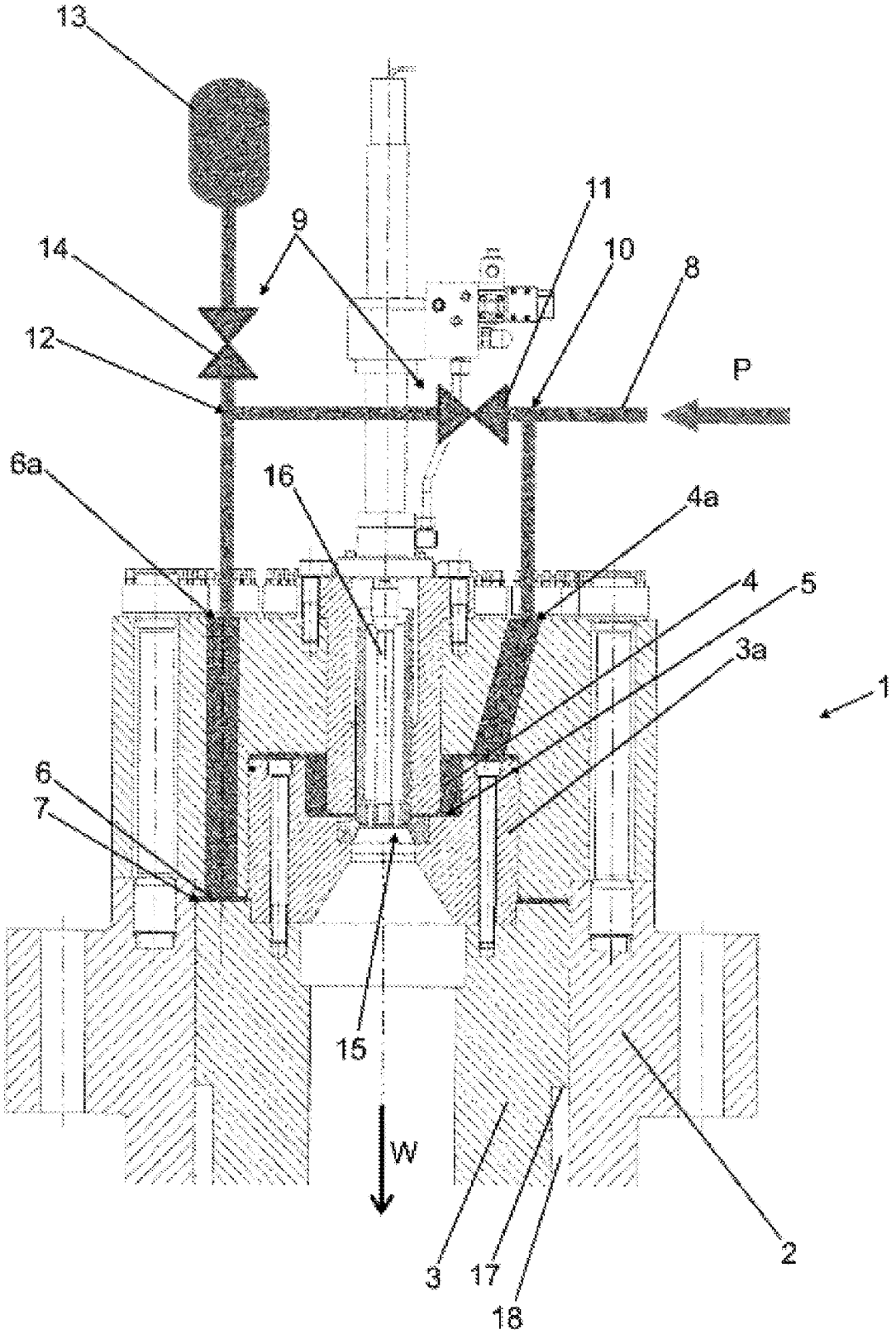
FIG. 1 shows a sectional view of a hydraulic cylinder of a forming machine according to the invention in a first exemplary embodiment of the invention.
Figure 2:
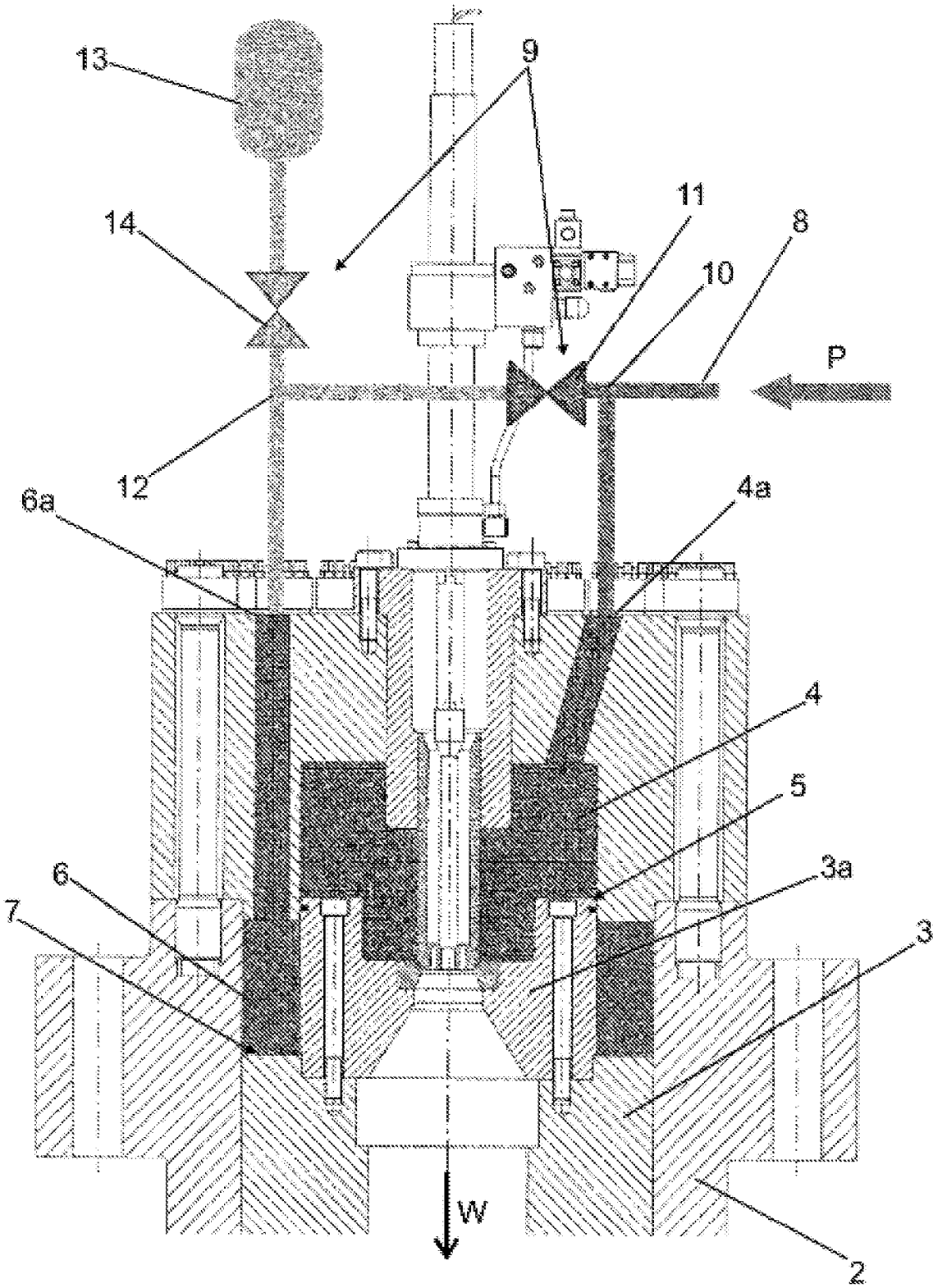
FIG. 2 shows the hydraulic cylinder of FIG. 1 in another operating mode.

The hydraulic cylinder 1 according to the invention as shown in FIG. 1 comprises a cylinder 2, in which a piston element is guided in linear displacement along a working direction W.

The piston element 3 has a cylindrical step 3*a*, which protrudes into a corresponding shoulder of the cylinder 2. In this way, a first partial chamber 4 is hydraulically defined by means of a first partial surface 5 of an active surface of the piston element 3. The first partial chamber has substantially the shape of a solid cylinder.

The first partial chamber 4 is hydraulically separated by the step 3*a* from a second partial chamber 6 by means of a second partial surface 7 of the active surface of the piston element 3. The second partial chamber 6 has substantially the shape of an annular cylinder.

The partial chambers 4, 6 together form a cylinder chamber of the cylinder 2. The active surface of the piston element 3 is the sum of the partial surfaces 5, 7. The size of the partial chambers 4, 6 varies according to the instantaneous position of the piston element 3 in the cylinder 2.

Each of the partial chambers 4, 6 has a respective opening 4*a*, 6*a*, through which a hydraulic fluid can flow into the partial chamber 4, 6. The openings 4*a*, 6*a* are connected by hydraulic lines 8 to a valve assembly 9 and a hydraulic pump unit (not shown). A flow direction of the fluid when subjected to working pressure by the pump unit is indicated as arrow P.

The partial chambers 4, 6 are hydraulically separated from each other, according to the preceding remarks, but they can also be hydraulically joined together as needed, depending on the design of the valve assembly 9.

In the present instance, the valve assembly 9 comprises, starting from the pump unit, a first branch 10, a first valve 11 located after this, and a second branch 12 located after this. The first branch 10 leads to the first partial chamber 4, so that, in the present example, this branch is permanently subjected to the fluid under working pressure by the pump unit.

The second branch 12 leads, on the one hand, to the second partial chamber 6 and, on the other hand, to a reservoir 13, which can be blocked by a second valve 14 between the second branch 12 and the reservoir 13. The reservoir is filled with fluid substantially under atmospheric pressure.

A drain 15 of the first partial chamber 4 leads to a sump and/or back to a suction side of the pump unit. The drain 15 can be closed in a controllable manner by a pilot piston 16 that can be driven to move in the working direction W, so that the pilot piston 16 with the drain 15 forms a control valve of the valve assembly 9. In the present case, the position of the piston element 3 in the working direction is adjusted by way of the pilot piston 16. In the present case, the pilot piston 16 is likewise hydraulically driven, but may also have an electric motor or some other drive, depending on the requirements in each case.

Furthermore, for the dynamic changing of the position of the piston element 3 in both directions, a significantly smaller resetting force presses against the piston element 3 in a resetting chamber 18 via a resetting active surface 17.

The resetting active surface 17 is likewise subjected to fluid under working pressure. The working pressure of the fluid here, by contrast with the two partial chambers, does not act in the working direction, but in the opposite direction.

The functional principle of the pilot piston is also presented in detail in DE 198 46 348 A1.

Now, embodiments of the invention functions as follows:

In a first operating mode, the first valve 10 is closed and the second valve 14 is opened. In this way, only the first partial chamber 4 is supplied with fluid under working pressure by the pump unit. The second partial chamber is connected via the second valve to the reservoir 13. This ensures a continual filling with fluid under atmospheric pressure or slightly higher pressure to improve the flow velocity.

Under these conditions, a maximum force of the piston element 3 is reduced, while at the same time a rapid piston movement is attained for a given volume flow through the pump unit.

In a second operating mode, the first valve 10 is opened and the second valve 14 is closed. In this way, the reservoir 13 is no longer in communication with the cylinder 2, and the two partial chambers 4, 6 are hydraulically connected in parallel.

This corresponds to the operation of a traditional hydraulic cylinder, whose working chamber amounts to the sum of the partial chambers 4, 6 and whose active surface amounts to the sum of the partial surfaces 5, 7. In this way, a greater maximum force of the piston element 3 is achieved as compared to the first operating mode, while the speed of the piston movement is slower for the same volume flow of the fluid.

Figure 3:
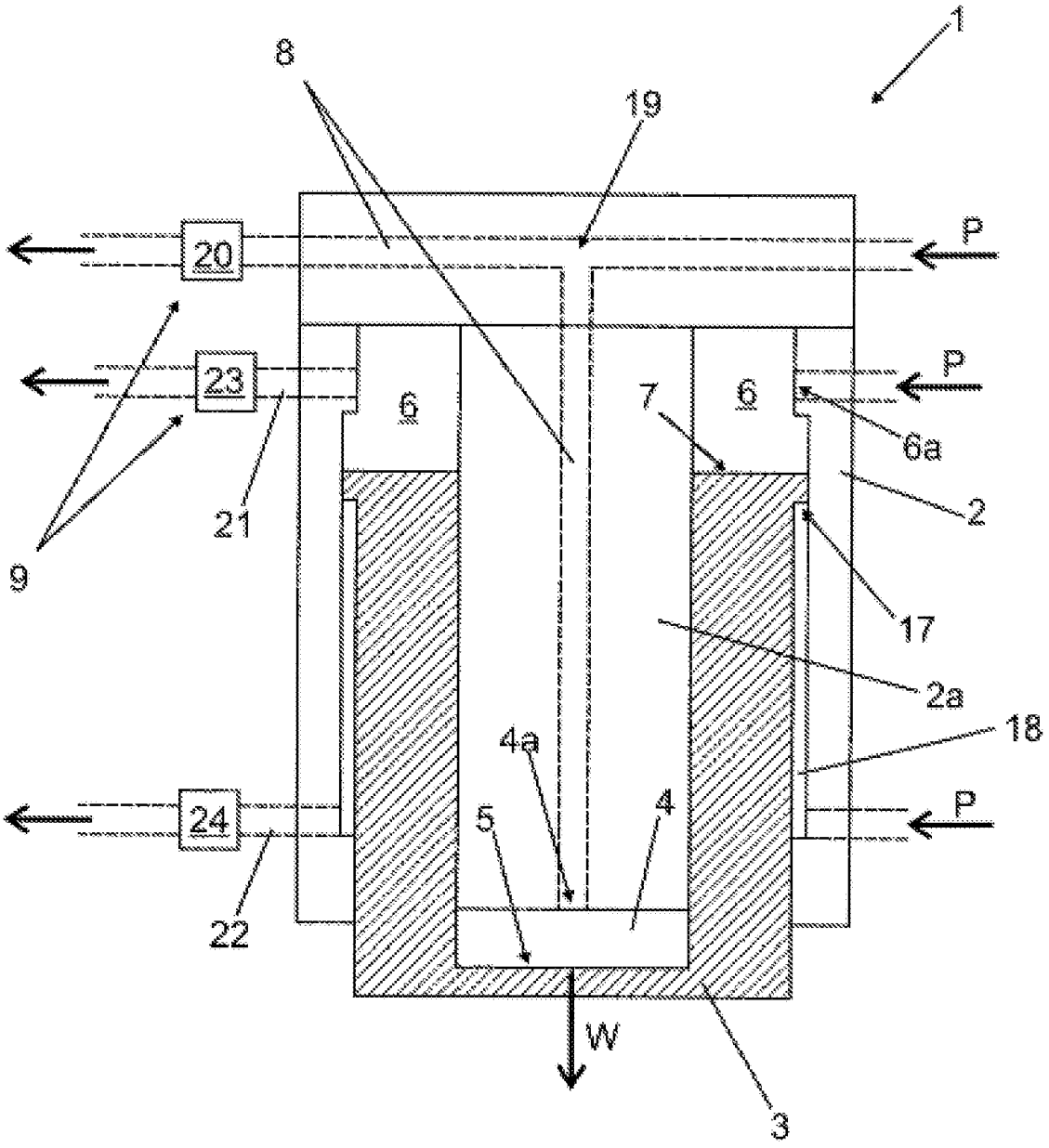
FIG. 3 shows a sectional view of a hydraulic cylinder of a forming machine according to the invention in a second exemplary embodiment of the invention.

In a second embodiment of the invention according to FIG. 3, a simplified valve assembly 9 with no pilot piston 16 is chosen. Functionally identical components are given the same reference numbers as in the first example.

The piston element 3 is shown hatched in the schematic drawing. A protruding cylindrical step 2*a* in this example is formed as part of the cylinder 2, so that the piston element substantially has a cup shape. This choice of configuration is independent of the design of the valve assembly 9.

In the present case, the valve assembly 9 has a first branch 19, which leads to the first partial chamber 4. Downstream from the branch 19 is located a valve 20.

The second partial chamber 6 and the resetting chamber 18 are directly supplied with fluid and have outlets 21, 22. Behind the outlets 21, 22, respective valves 23, 24 are situated.

As can be recognized, one of the partial chambers 4, 6 or the resetting chamber 18 is subjected to fluid under working pressure precisely when its associated valve 20, 23, 24 is closed.

In the case of the opening of the respective valve 20, 23, 24, the fluid flows in a circuit without building up pressure. Accordingly, the three feed lines P are each separately pressurized and not switched in parallel with each other. This can be achieved, for example, by separate hydraulic pumps.

The operating modes of the hydraulic cylinder according to the second example are entirely analogous to those of the first example. In the second example, furthermore, it is easily possible to select which of the partial chambers 4, 6 will be subjected individually to working pressure. In this way, the operation can be chosen to be even more flexible, for example, when the partial surfaces are designed with different sizes.

In the present instance, a hydraulic cylinder 1 according to one of the above described operating modes is designed as part of a forming machine in the form of a radial forging press (not shown). The sum of the active surfaces, corresponding to the total cross-sectional area of the cylinder chamber of the cylinder 2, amounts to around 25,000 cm. The working pressure of the fluid is around 400 bars. The size ratio of the two partial surfaces 5, 7 is approximately 50:50.

The forming machine comprises four tools working in pairs against each other in a cross pattern, each of the tools being driven by a hydraulic cylinder 1, as described above.

In keeping with the above-described operating modes of the hydraulic cylinder 1, the following operating modes of the forming machine or forging press are supported:

Smoothing: This operation requires rapid tool strokes at high frequency, while the maximum force should be smaller in design, thanks to a smaller forming stroke. Accordingly, the hydraulic cylinders 1 are used in the first of the above-described operating modes.

Forging: This operation requires slow tool strokes of low and medium frequency, while the maximum force must be large on the basis of a high forming stroke. Accordingly, the hydraulic cylinders 1 are used in the second of the above-described operating modes.

Furthermore, it may be provided that, during the forging, a switching between the operating modes is carried out as needed, in order to move the tools rapidly over longer distances when no forming is being carried out. This may happen, for example, in the course of advancing a workpiece and it allows overall an acceleration of the forging process.

The invention claimed is:

1. A hydraulic cylinder, comprising:

a cylinder, a piston element movably guided in the cylinder in a working direction W and having an active surface, and a first opening for feeding a fluid into a cylinder chamber by way of the active surface, wherein a working pressure of the fluid acting on the active surface drives the piston element in the working direction, in that the active surface has a first partial surface and at least one second partial surface, wherein the cylinder chamber is divided into a first partial chamber with the first opening by the first active surface as well as a second partial chamber with a second opening by the second partial surface, and wherein the partial chambers are hydraulically separated from each other at least in a selectable operating mode, wherein on one of the piston element or cylinder, a cylindrical step protrudes parallel to the working direction for separating the partial chambers.

2. The hydraulic cylinder as claimed in claim 1, wherein a ratio of the sizes of the partial surfaces is asymmetrical and lies between 45:55 and 20:80.

3. The hydraulic cylinder as claimed in claim 1, wherein the partial chambers extend concentrically about a center axis of the cylinder.

4. The hydraulic cylinder as claimed in claim 1, wherein the partial chambers are connected to a hydraulic pump unit and a valve assembly, wherein the valve assembly enables the partial chambers to admit fluid in at least two operating modes.

5. The hydraulic cylinder as claimed in claim 4, wherein, in a first of the operating modes a rapid advancement of the piston element is present under reduced piston force, while in a second of the operating modes, a slow advancement of the piston element is present under high piston force, and wherein the operating modes are realized by different admission of fluid under working pressure to the partial chambers.

6. The hydraulic cylinder as claimed in claim 4, wherein the valve assembly comprises a control valve with a pilot piston which is movable in the working direction.

7. The hydraulic cylinder as claimed in claim 4, wherein one of the partial chambers can be connected by the valve assembly to a hydraulic reservoir, especially one that is pressure-free.

8. The hydraulic cylinder as claimed in claim 4, wherein at least one of the partial chambers, especially both partial chambers, can be subjected to the fluid by means of a valve downstream from the partial chamber.

9. The hydraulic cylinder as claimed in claim 1, wherein the hydraulic cylinder comprises a resetting active surface, wherein the piston element can be reset opposite to the working direction by admitting the fluid to the resetting active surface.

10. The hydraulic cylinder as claimed in claim 1, wherein the entire active surface of the piston element amounts to at least 1000 $cm^2$.

11. The hydraulic cylinder as claimed in claim 1, wherein three or more hydraulically separable partial chambers are provided with their associated partial surfaces of the piston element in each case.

* * * * *